United States Patent [19]

Klym

[11] Patent Number: 4,854,103

[45] Date of Patent: Aug. 8, 1989

[54] BUILDING SYSTEM WITH INTERLOCKING BLOCKS

[76] Inventor: Kyle Klym, 11 Melmar Place, Winnipeg, Manitoba, Canada, R2G 0P3

[21] Appl. No.: 119,841

[22] Filed: Nov. 12, 1987

[51] Int. Cl.[4] ..... E04C 1/10

[52] U.S. Cl. ..... 52/593; 52/286; 52/589; 52/594; 446/127

[58] Field of Search ..... 52/583, 589, 592, 593, 52/594, 603, 605, 606, 286, 442, 602, 604, 284, 286, 505; 446/127, 124, 120, 122; D25/113–118

[56] References Cited

U.S. PATENT DOCUMENTS

| | | | |
|---|---|---|---|
| D. 214,268 | 5/1969 | Phillips | D25/113 |
| 1,419,623 | 6/1922 | Fessenden . | |
| 1,516,473 | 11/1924 | Davis . | |
| 2,749,739 | 6/1956 | Zagray | 52/286 |
| 2,902,853 | 7/1957 | Lofstrom . | |
| 3,683,578 | 8/1972 | Zimmerman | 52/583 X |
| 3,888,060 | 6/1975 | Haener . | |
| 3,962,842 | 6/1976 | Wilhelm . | |
| 4,075,808 | 2/1978 | Pearlman . | |
| 4,262,463 | 4/1981 | Hapel | 52/594 X |
| 4,372,091 | 2/1983 | Brown et al. | 52/593 |
| 4,627,209 | 12/1986 | Schwartz | 52/593 X |
| 4,640,071 | 2/1987 | Haener | 52/589 X |

FOREIGN PATENT DOCUMENTS

| | | | |
|---|---|---|---|
| 48006 | 10/1933 | Denmark | 52/594 |

*Primary Examiner*—David A. Scherbel
*Assistant Examiner*—Richard Chilcot, Jr.
*Attorney, Agent, or Firm*—Adrian D. Battison; Stanley G. Ade; Murray E. Thrift

[57] ABSTRACT

An interlocking system of blocks comprises a basic block having side walls and transverse webs all of constant thickness with the webs being rectangular in shape and offset upwardly from the bottom of the edges of the side walls to form recesses at the bottom and projecting portions at the top which interlock with the next adjacent upper row. The webs are spaced equidistantly along the block with the end most webs spaced from the ends of the blocks by one half of the spacing. Corner blocks are formed so that the web at the end of the block has an outer face coincident with the end face of the block and a recess in the lower edge of each of the side walls. The blocks are simple to manufacture, resistant to damage and easily assembled.

10 Claims, 3 Drawing Sheets

BUILDING SYSTEM WITH INTERLOCKING BLOCKS

BACKGROUND OF THE INVENTION

This invention relates to a building system with interlocking blocks of a type which can be assembled without the necessity for mortar between the blocks to form a completed wall of the blocks. The completed wall may or may not be reinforced by poured concrete or the aggregate into hollow cells within the blocks.

Construction of this general type are shown in U.S. Pat. Nos. 156,473 (Davis), 1,419,623 (Fessenden), 2,902,853 (Lofstrom), 3,888,060 (Haener), 3,962,842 (Wilhelm) and 4,075,808 (Pearlman).

In addition a construction is known which was available in Canada some 20 years ago known as "Lock-a-block" which used interlocking blocks of a molded concrete material and which avoided the necessity for mortal.

A number of requirements for systems of this type are as follows:

(a) The block is simple to manufacture.

(b) The block is not prone to damage by rough handling.

(c) The blocks can be assembled simply by placing one on top of another.

(d) The system is flexible in that walls of different dimensions can be formed by using part blocks or cutting parts of blocks.

(e) The wall can be reinforced if necessary by pouring a concrete filling material into cavities within the wall.

(f) Corners and jamb faces of the construction can be formed easily without the necessity of altering any blocks.

(g) Openings or spaces in the wall construction can be formed at any derived position without affecting the interlocking principle.

(h) The construction is safe in trial even partly completed wall is stable and is unlikely to fall.

The prior patents above do not entirely satisfy the above requirements and have generally been found unsatisfactory and have obtained little success in the field.

SUMMARY OF THE INVENTION

One of the objects of the present invention, therefore, is to provide an improved block of this type which is more satisfactory for its intended purposes.

According to the invention, therefore, there is provided a set of building blocks for use in an interlocking building system, the set comprising a plurality of basic blocks each formed from an integrally molded aggregate material to define two spaced rectangular block sides of the same dimensions with edges of one side being aligned with corresponding edges of the other side and a plurality of spaced transverse webs interconnecting said one side to said other side such that a width of the block transverse to the sides is less than a length of the block along the sides, each web extending from one side to the other side and being arranged to include an upwardly projecting portion above aligned upper edges of the sides and a correspondingly shaped recess upwardly of aligned lower edges of the sides, the webs being equidistantly spaced along the block with outermost ones of the webs being spaced from respective end edges of the sides by distance equal to one half of the spacing between adjacent webs and arranged such that when two blocks are placed directly on top of one another and when two blocks are placed on top of one another offset longitudinally by the length of one half of a block, the webs of an upper one of the blocks lie directly upon and aligned with the webs of a lower one of the blocks with the projecting portions of the lower webs extending into and filling the recesses of the upper webs, and a plurality of corner blocks each of said corner blocks being formed from an integrally molded aggregate material to define two spaced rectangular block sides of the same dimensions with edges of one side being aligned with corresponding edges of the other side and a plurality of spaced transverse webs interconnecting said sides such that a width transverse to the sides of each block is less than a length along the sides of the block, each web extending from one side to the other side and being arranged to include an upwardly projecting portion above aligned upper edges of the sides and a correspondingly recess upwardly of aligned lower edges of the sides, the webs being spaced along the length of the block with an outermost one of the webs at one end of the block being spaced from respective end edges of the sides and an outermost one of the webs at the other end of the block being arranged directly interconnecting respective end edges of the sides, both of said block sides having an recess in said lower edge thereof of the same shape as the projecting portions of the webs and arranged adjacent to but spaced from said other end edges of the sides by a distance no greater than the thickness of a side of the block.

Preferably the webs are of constant thickness and extend upwardly into a rectangular projecting portion of the same width as the inside surfaces of the sides, with the corresponding shape recess at the bottom of the block. In addition it is preferred that there is an even number of webs arranged equidistantly spaced along the block, with end ones of the webs spaced from the adjacent end of the block by a distance one half of the spacing between the webs. This enables the sides and the webs to sit directly on top of one another in an assembly of the basic blocks to form continuous cells vertically within the wall construction which may be, if required, filled with a reinforcing setable aggregate material and/or reinforcing devices such as rebar, tubes, mesh or the like.

The recess along the underside of the block enables the lower most blocks to be placed upon a suitable ridge formed in the footing so that the wall and the footing are interlocked by the cooperation of the ridge with the recess and with the projections with the recesses in the blocks thereabove.

In addition the construction according to the present invention can be used as a toy structure.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 7 is a top plan view of two corner blocks assembled at a corner, each of the blocks being modified with regard to the spacing of the webs.

In the drawings like characters of reference indicate corresponding parts in the different figures.

DETAILED DESCRIPTION

Figure 1:
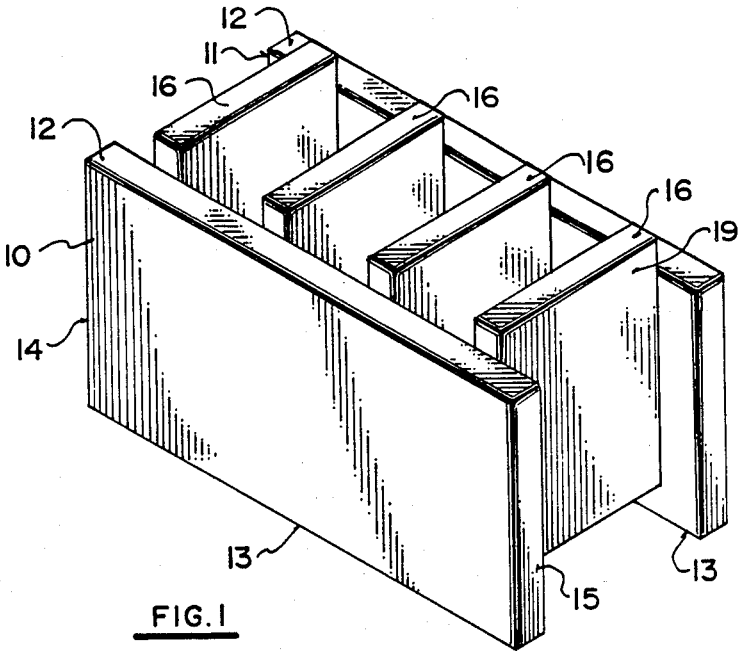
FIG. 1 is an isometric view of a basic block of the building system.

Each block, whether that be a basic block, a corner block, or a jamb block comprises a integrally molded body formed from a setable aggregate material such as concrete or cinder based aggregate. The body has a pair of rectangular sides 10 and 11 which have upper edges 12 which are aligned in a horizontal plane, lower edges 13 which are similarly aligned in a lower horizontal plane, and end edges 14 and 15 which are aligned in spaced vertical planes defining the ends of the block.

The sides are connected by transverse webs 16 which extend from an inner surface of one side to an inner surface of the other side and which hold the sides at a spaced location forming an integral rectangular block. Each of the webs is of constant thickness and substantially the same thickness as the side walls which may be in one embodiment of the order of 1" in a block having a length of 16" and a height and width of 8". In this regard it is pointed out that it is important that the width of the block be exactly or substantially exactly equal to ½ of the length of the block although of course the absolute dimensions may vary.

Figure 5:
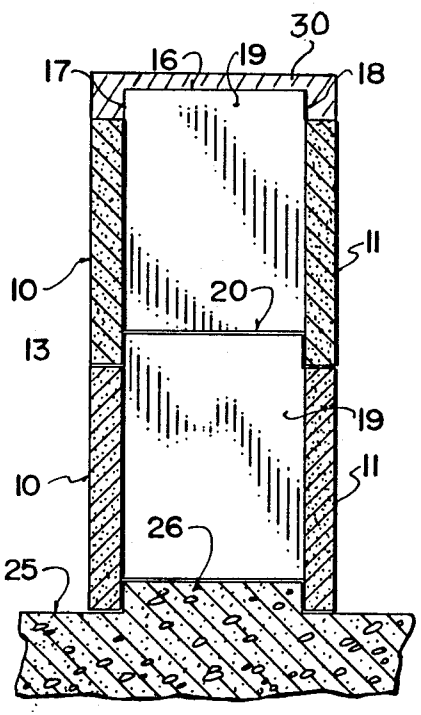
FIG. 5 is a transverse cross-sectional view of a portion of wall built using the basic blocks of FIG. 1.

Each of the webs is thus rectangular in shape defined by sides of the web running along the inside of the face of the side walls 10 and 11 as best shown in FIG. 5. The sides thus indicated at 17 and 18 extend upwardly beyond the upper edges of the side walls to form a projecting portion 19 of a height less than the height of the block and which may be in the order of 1".

A similarly shaped and dimensioned recess is formed at the lower part of the block in the respective web 16 by an omitted portion of the web 16 so the bottom of the web indicated at 20 is at a position upwardly of the lower edge of the side walls by an amount equal to the height of the projection 19. Thus as shown in FIG. 5, one block can sit on top of another block with the projecting portion of the lower block entering into and filling the recess in the web of the upper block.

There is an even number of webs in the basic block and in the example shown there are four such webs which are equidistantly spaced along the length of the block with the end most webs spaced from the ends of the block by a distance equal to ½ of the distance between the web and the next adjacent web. In this way when one block is placed end to end with another block, the spacing between the webs is constant. Thus when the next layer of blocks is applied on top of first layer, whether those blocks are placed directly one on top of the other or placed straddling the junction between two blocks, the webs of the upper layer are arranged so that they lie directly on top of the webs of the lower layer thus properly supporting the block and ensuring that each block is supported by its whole surface area on the block below.

Figure 2:
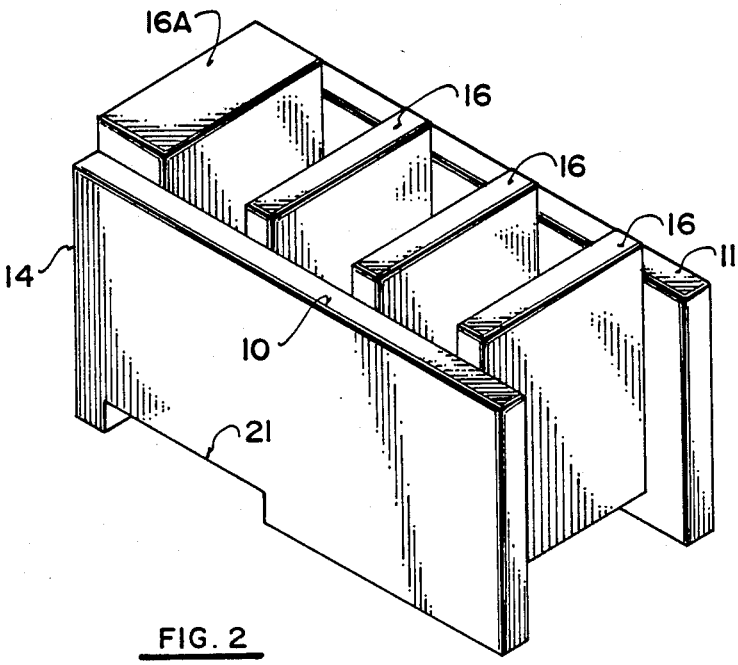
FIG. 2 is an isometric view similar to FIG. 1 of a corner block of the building system.
Figure 3:
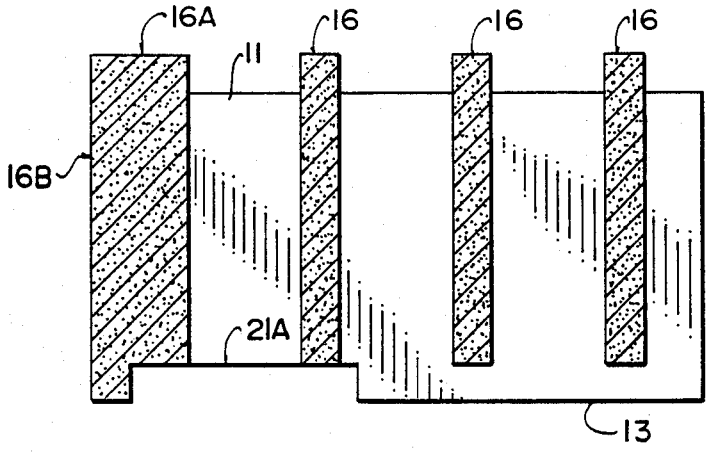
FIG. 3 is a longitudinal cross-section of the block of FIG. 2.
Figure 6:
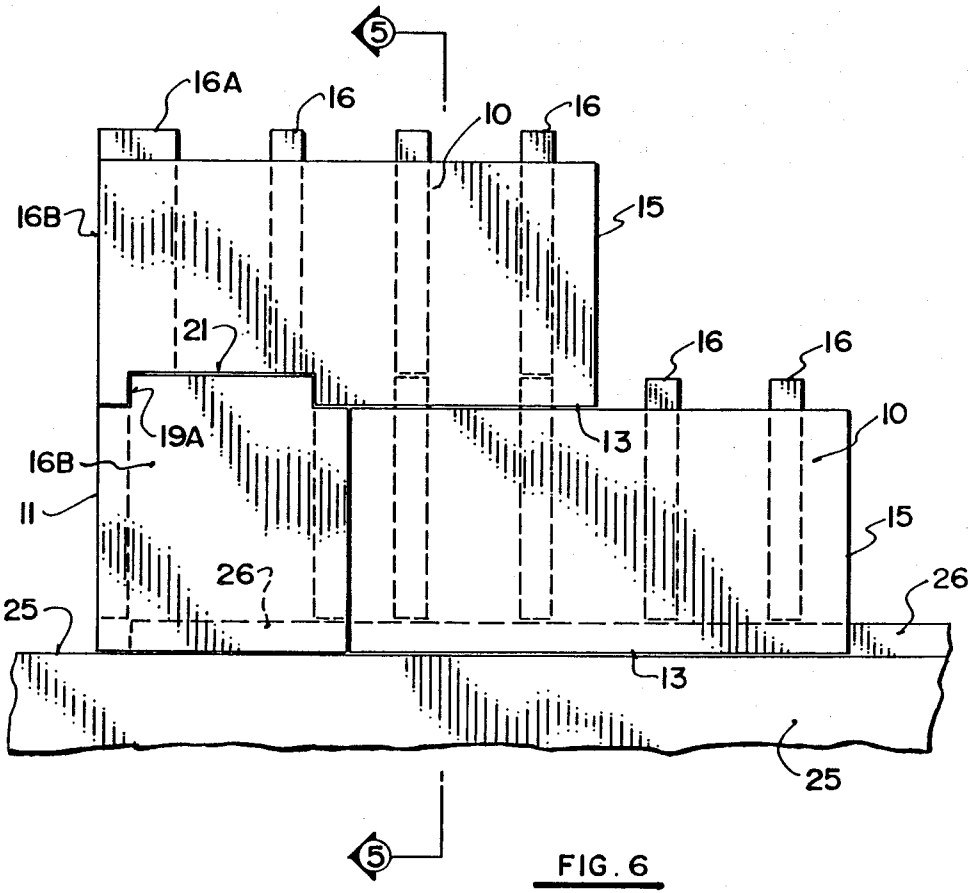
FIG. 6 is a side elevational view of a corner of the wall showing two corner blocks in assembled condition together with one of the basic blocks.

Turning now to the corner block shown in FIGS. 2, 3 and 6, this is of substantially the same construction as the basic block except for the following modifications. Firstly, the end most web indicated at 16A is of increased thickness so that it fills the space from its lower position adjacent to but spaced from the end up to the end of the block so that an end face 16B of the web coincides with the end edges 14 of the side walls 10 and 11. This ensures that the end face of the block is a complete flat planar surface to define an outer surface of part of the wall structure. The end most portion of the web of the thickness of the other webs extends to a lower edge thereof coincident with the lowermost edge of the side walls.

In addition the corner block includes a recess 21 which is of the same dimensions as the projecting portions 19 of the webs so that, as shown in FIG. 6, the recess 21 sits over the end most projection 19A of the corner block on the next adjacent lower row. The end most web is also recessed at this position across its full lower surface. As shown in cross-section in FIG. 3, the other side wall also includes a recess 21A of the same size as and directly aligned with the recess 21 so as to engage over the further webs. In addition the use of the recesses on both sides enables the block to be used either as a left or right hand corner block.

Figure 4:
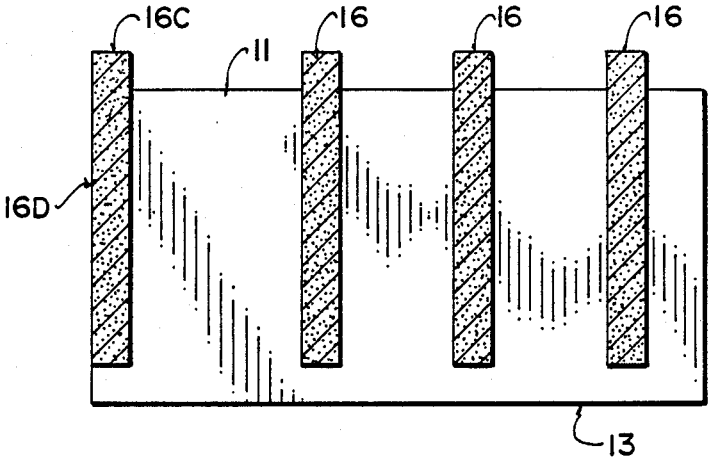
FIG. 4 is a longitudinal cross-section similar to FIG. 3 of one arrangement of a jamb block.

In FIG. 4 is shown a jamb block. In this particular construction of the jamb block, the web indicated at 16C is of the same thickness as the webs 16 but is moved to an end position on the block so as to form a planar end face 16D of the block but in this case the spacing between the web 16C and the next adjacent web 16 is thus increased.

In an alternative arrangement (not shown) the jamb block can be manufactured to the follow the construction of the corner block of FIG. 3 with the increased thickness end web, the only difference then being firstly the removal or absence of the recesses 21 and 21A and secondly the omission of the lowermost part of the web 16A leaving that web recessed as all of the other webs. In addition the corner block shown in FIG. 3 can be modified to follow the construction of the inner web shown in FIG. 4. In a yet further arrangement of jamb block, the web 16D is spaced inwardly from the adjacent end faces of the sides to allow a recessed area within which a door or window jamb can be received, thus rendering it more resistant to being forced in unauthorized attempt to enter. The recesses area defined by the underside of the webs 16 can receive a lintel for supporting the next above layer of blocks during the building process.

In FIGS. 5 and 6 there is shown a footing 25 which includes a central ridge 26 which is formed on an the footing as it is laid and then allowed to set. After setting, the first layer of blocks can be placed directly on top of the ridge 26 and are located in place by that ridge. The size of the ridge of course is arranged to follow the recesses in the webs so the ridge can be continuous and extends up into the lower area of the block for engagement with the underside of each of the webs in turn. A side extention of the ridge can be provided to fill the recess 21 or 21A of the corner block.

Subsequent to a assembly of a complete wall, if necessary rebar, pipe or mesh can be inserted into the channels from between the webs of the wall in a vertical direction following which a set aggregate material can be poured into the individual channels.

Top caps indicated at 30 in FIG. 5 can be applied at the upper edge of the wall when completed if necessary to close the channels and to provide an aesthetic finishing layer. Such a top cap will comprise simply an inverted channel member defining a recess within the channel member of a size to receive the projecting portions of the webs so that sides of the channel member sit on the upper edges of the side walls of the upper layer of blocks.

FIG. 7 shows an arrangement of corner blocks generally of the type shown in FIG. 3. In this case, however, referring to the uppermost block indicated at 31, the end web 32 of that block is positioned at the end face of the block as described in FIG. 4. In this case, however, the next web 33 is moved along the block away from the end web and toward the third web 34 thus reducing the spacing between the webs 33 and 34 but increasing the spacing between the webs 32 and 33. This forms, as shown in FIG. 7, a square opening at the corner so that the webs 32 and 33 lie directly over the sides 35 and 36 of the next adjacent underlying block 37. In this case, both the webs 32 and 33 are of increased height so as to extend to the bottom edge of the sides. Using such a corner block, it is necessary to cut a groove in the base ridge 26 to accommodate the web 33.

The webs 32 and 33 and the side walls between the webs 32 and 33 may be increased in width to provide additional strength in view of the increased spacing between the webs.

In an alternative arrangement (not shown) it may be necessary in some circumstances to increase the width of a block relative to its length, for example for increased strength at a lowermost portion of the wall. In this case the general formula that the width is equal to one-half of the length no longer applies. In regard to corner blocks, therefore, it is necessary to add the difference between the width of the block and one-half of the length of the block to the spacing between the webs 32 and 33 so that web 33 lies at the edge of the block 37. For example, it may be necessary to increase the width of the block to ten inches in which the case the length of a corner block will be 18 inches in view of the additional two inches which are required in the length of the block between the webs 32 and 33.

In construction a T-junction in the wall, the above described corner blocks can be used, but each of the three parts of the wall in turn includes a corner block, the remaining parts being formed by the basic blocks.

In constructing a cavity wall, wall tie can be used which include metal strips of the width of a side of the block so that the strip, fill the area between a block and the next overlying block, the strips being connected one to the next by wires extending either side of the webs.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A set of building blocks for use in an interlocking building system, the set comprising a plurality of basic blocks each formed from an integrally molded aggregate material to define two spaced rectangular block sides of the same dimensions with edges of one side being aligned with corresponding edges of the other side and a plurality of spaced transverse webs interconnecting said one side to said other side such that a width of the block transverse to the sides is less than a length of the block along the sides, each web extending from one side to the other side and being arranged to include an upwardly projecting portion above aligned upper edges of the sides and a correspondingly shaped recess upwardly of aligned lower edges of the sides, the webs being equidistantly spaced along the block with outermost ones of the webs being spaced from respective end edges of the sides by distance equal to one half of the spacing between adjacent webs and arranged such that when two blocks are placed directly on top of one another and when two blocks are placed on top of one another offset longitudinally by the length of one half of a block, the webs of an upper one of the blocks lie directly upon and aligned with the webs of a lower one of the blocks with the projecting portions of the lower webs extending into and filling the recesses of the upper webs, and a plurality of corner blocks each of said corner blocks being formed from an integrally molded aggregate material to define two spaced rectangular block sides of the same dimensions with edges of one side being aligned with corresponding edges of the other side and a plurality of spaced transverse webs interconnecting said sides such that a width transverse to the sides of each block is less than a length along the sides of the block, each web extending from one side to the other side and being arranged to include an upwardly projecting portion above aligned upper edges of the sides and a correspondingly recess upwardly of aligned lower edges of the sides, the webs being spaced along the length of the block with an outermost one of the webs at one end of the block being spaced from respective end edges of the sides and an outermost one of the webs at the other end of the block being arranged directly interconnecting respective end edges of the sides, both of said block sides having an recess in said lower edge thereof of the same shape as the projecting portions of the webs and arranged adjacent to but spaced from said other end edges of the sides by a distance no greater than the thickness of a side of the block.

2. The invention according to claim 1 wherein the projecting portions are rectangular.

3. The invention according to claim 1 wherein the projecting portions extend from an inner surface of one side to an inner surface of the other side.

4. The invention according to claim 1 wherein the projecting portions are substantially equal in thickness to the thickness of the respective web.

5. The invention according to claim 1 wherein the webs and the sides are of substantially constant and equal thickness.

6. The invention according to claim 1 wherein the width of each block is substantially exactly equal to one half of the length of each block.

7. The invention according to claim 1 wherein both block sides of each corner block includes a recess with the recesses being aligned transversely of the block.

8. The invention according to claim 1 including a plurality of jamb blocks each of which is constructed substantially identically to a basic block except that one web is arranged directly at an end of the block so as to form a jamb face for the block.

9. An interlocking assembled building construction comprising a plurality of basic blocks each formed from an integrally molded aggregate material to define two spaced rectangular block sides of the same dimensions with edges of one side being aligned with corresponding edges of the other side and even number of spaced transverse webs interconnecting said one side to said other side such that a width transverse to the sides of each block is less than a length along the sides of the block, each web extending from one side to the other side and being arranged to include an upwardly projecting portion above aligned upper edges of the sides and a correspondingly shaped recess upwardly of aligned lower edges of the sides, the webs being equidistantly spaced along the block with outermost ones of the webs being spaced from respective end edges of the sides by distance equal to one half of the spacing between adjacent webs and arranged such that when two blocks are placed directly on top of one another and when two blocks are placed on top of one another offset longitudinally by the length of one half of a block, the webs of an upper one of the blocks lie directly upon and aligned with the webs of a lower one of the blocks with the projecting portions of the lower webs extending into and filling the recesses of the upper webs, and a plurality of corner blocks each of said corner blocks being formed from an integrally molded aggregate material to define two spaced rectangular block sides of the same dimensions with edges of one side being aligned with corresponding edges of the other side and a plurality of spaced transverse webs interconnecting said sides such that a width transverse to the sides of each block is less than a length along the sides of the block, each web extending from one side to the other side and being arranged to include an upwardly projecting portion above aligned upper edges of the sides and a correspondingly recess upwardly of aligned lower edges of the sides, the webs being spaced along the length of the block with an outer one of the webs at one end of the block being spaced from respective end edges of the sides and an outermost one of the webs at the other end of the block being arranged directly interconnecting respective end edges of the sides, both of said block sides having an recess in said lower edge thereof of the same shape as the projecting portions of the webs and arranged adjacent to but spaced from said other end edges of the sides by a distance no greater than the thickness of a side of the block so that said end web of one corner block projects into a recess of a corner block thereon arranged on right angles thereto.

10. The invention according to claim 9 including a footing having a base surface and a continuous elongate ridge projecting upwardly therefrom, the height and width of the ridge being equal to the height and width of the projecting portions of said webs.

* * * * *